US010703391B2

(12) United States Patent
Schatton

(10) Patent No.: US 10,703,391 B2
(45) Date of Patent: Jul. 7, 2020

(54) CABIN WITH ROTATABLE CABIN DOOR FOR A VEHICLE

(71) Applicant: SIEMENS MOBILITY GMBH, Munich (DE)

(72) Inventor: Christopher Schatton, Viersen (DE)

(73) Assignee: Siemens Mobility GmbH, Munich (DE)

( * ) Notice: Subject to any disclaimer, the term of this patent is extended or adjusted under 35 U.S.C. 154(b) by 304 days.

(21) Appl. No.: 15/570,452

(22) PCT Filed: Apr. 18, 2016

(86) PCT No.: PCT/EP2016/058563
§ 371 (c)(1),
(2) Date: Oct. 30, 2017

(87) PCT Pub. No.: WO2016/173878
PCT Pub. Date: Nov. 3, 2016

(65) Prior Publication Data

US 2018/0148073 A1 May 31, 2018

(30) Foreign Application Priority Data

Apr. 30, 2015 (DE) ..... 10 2015 208 075

(51) Int. Cl.
*B61D 19/00* (2006.01)
*B61D 19/02* (2006.01)
(Continued)

(52) U.S. Cl.
CPC ..... *B61D 19/005* (2013.01); *B61D 19/02* (2013.01); *B61D 35/005* (2013.01); *E05D 15/56* (2013.01);
(Continued)

(58) Field of Classification Search
CPC .... B61D 35/005; B61D 35/002; B61D 19/02; B61D 19/005; B60R 15/04; B60R 15/00; B64D 11/02; E05D 15/56
See application file for complete search history.

(56) References Cited

U.S. PATENT DOCUMENTS 2,587,868 A * 3/1952 Madland ..... B61D 19/005 49/472
2009/0007491 A1* 1/2009 Jarolim ..... B61D 19/008 49/210
(Continued)

FOREIGN PATENT DOCUMENTS

DE 4336418 A1 4/1995
DE 19913318 A1 1/2000
(Continued)

*Primary Examiner* — Jason C Smith
(74) *Attorney, Agent, or Firm* — Laurence Greenberg; Ralph Locher

(57) ABSTRACT

A cabin for a vehicle includes a cabin wall having an opening and a door for opening and closing the opening. The door is moved about a rotational point and includes a movable door leaf which has a concentric segment. The cabin wall additionally forms a door stop in the closing direction of the door. The door leaf further has a linear segment with a fixed end and a free end. The linear segment adjoins the concentric segment at the fixed end in the closing direction of the door, and the free end of the linear segment forms a closing edge in the closing direction of the door. The closing edge lies against the door stop when the door is closed. A vehicle including an interior having the cabin is also provided.

13 Claims, 5 Drawing Sheets

(51) Int. Cl.

| | |
|---|---|
| ***B61D 35/00*** | (2006.01) |
| ***E05D 15/56*** | (2006.01) |
| ***E06B 3/46*** | (2006.01) |

(52) U.S. Cl.

CPC ..... *E06B 3/4636* (2013.01); *E05Y 2900/502* (2013.01); *E05Y 2900/506* (2013.01); *E05Y 2900/51* (2013.01); *E05Y 2900/514* (2013.01); *E05Y 2900/531* (2013.01)

(56) References Cited

U.S. PATENT DOCUMENTS

| | | | | |
|---|---|---|---|---|
| 2017/0253256 | A1* | 9/2017 | Krueger ..... | B61D 19/02 |
| 2018/0148073 | A1* | 5/2018 | Schatton ..... | B61D 19/02 |
| 2019/0309570 | A1* | 10/2019 | Horlendsberger .... | E06B 7/2303 |

FOREIGN PATENT DOCUMENTS

| | | | |
|---|---|---|---|
| DE | 29817742 | U1 | 2/2000 |
| DE | 102007007624 | A1 | 8/2008 |
| DE | 102008062462 | A1 | 6/2010 |
| EP | 1787884 | A1 | 5/2007 |
| EP | 2705997 | A1 | 3/2014 |
| FR | 2935946 | A1 | 3/2010 |
| RU | 125150 | U1 | 2/2013 |

* cited by examiner

CABIN WITH ROTATABLE CABIN DOOR FOR A VEHICLE

BACKGROUND OF THE INVENTION

Field of the Invention

The invention relates to a cabin which may be entered through a rotatable and/or pivotable door, as well as a vehicle having such a cabin.

In vehicles, in particular in rail vehicles for local traffic and long-distance traffic, disability-friendly unisex toilets in the form of cabins are used, in most cases said toilets being entered through a sliding door which moves on a circular path and in some cases also being operated automatically. Due to adjustments, however, the door leaf may be forced out of its true vertical alignment with the cabin floor which may lead to undesirable gaps with the door stop. It is thus possible to see through these gaps into the cabin which is actually closed and this is undesirable.

To prevent the gap caused by adjustments, the door stop may be formed by a type of pocket, the front of the door leaf moving therein and following the circumference of the circular path when the door is closed. As a result, small misalignments of the door leaf may be taken up. Due to the action of shear forces, however, the pocket function contains an increased risk of trapping the fingers and hands, specifically for children, and in currently known designs, the pocket function is only able to compensate for small tolerances relative to the vertical gap. When closing the door, the purely rotational movement leads to a frontal approach between the closing edge of the door leaf and the door stop.

SUMMARY OF THE INVENTION

The object is to permit a simpler adjustment of a rotating door. The object is also to design the closing of the door in a safer manner.

According to the invention, a cabin for a vehicle is provided, wherein the cabin is configured with an opening in a cabin wall. Moreover, a door is provided for opening and closing the opening, wherein the door is moved about a rotational point and comprises a movable door leaf which has a concentric segment. The cabin wall additionally forms a door stop in the closing direction of the door. According to the invention, the door leaf further has a linear segment with a fixed end and a free end, wherein the linear segment adjoins the concentric segment at its fixed end in the closing direction of the door. The free end of the linear segment of the door leaf forms a closing edge in the closing direction of the door, said closing edge lying against the door stop when the door is closed.

This configuration of the door leaf with an additional linear end segment has the advantage that the rotating door bears against the door stop in a translatory manner. This translatory movement is simpler to adjust relative to a purely rotational movement. Additionally, in order to avoid trapping the fingers a translatory movement is simpler to perform for a user than a rotational movement and no shear forces are present.

The distance of the fixed end from the rotational point in this case is smaller than the distance of the free end from the rotational point. In other words, the linear segment is arranged so as to be bent away outwardly relative to the circular path. This permits the door leaf to move in the direction of the door stop during the closure of the door.

A resilient sealing profile is advantageously arranged at the free end of the linear segment of the door leaf. In the closed state of the door, the sealing profile preferably bears from outside against the cabin wall in the region of the opening. In a preferred exemplary embodiment, the sealing profile is arranged such that in the closed state of the door it covers, preferably entirely, the closing edge of the door and the door stop from outside. Preferably, the sealing profile bears against the door stop of the door.

By means of the sealing profile, a generous covering of the gaps resulting from misalignments of the door leaf may be achieved. At the same time, trapping of the hands may be eliminated. Since the resilient, flexible sealing profile may produce a gap closure, a large distance may be created between the rigid components of the door leaf and the door stop. Moreover, the risk of squashing is further reduced by covering the stop.

Advantageously, the use of a sealing profile results in a simpler adjustment of the door during the first installation and during maintenance. This results in time-saving during installation and maintenance, since the adjustment only has to be directed toward the running properties during the opening and closing procedure.

Additionally, a compromise between smooth running and visual alignment relative to the extent of the closing gap is not necessary due to the large overlap between the sealing profile and the wall stop, since no visible vertical gap is present. Thus an orientation point for identifying a vertical faulty position is not present.

Preferably, the sealing profile extends over the entire height of the door leaf which is visible from outside. This enables only the visible region of the door stop to be fully covered. The non-visible region, which may extend in the floor or in the ceiling of the cabin, requires no sealing profile, thus saving costs.

In a preferred exemplary embodiment, the sealing profile consists at least partially of rubber or silicone. This permits the sealing profile to be produced in a particularly simple manner.

The sealing profile may comprise a first resilient element which in the closed state of the door bears between the free end of the door and the door stop. The first resilient element may be configured as a resilient nose, for example a rubber nose. The sealing profile may comprise a second resilient element which in the closed state of the door bears from outside against the cabin wall. The second resilient element may be configured as a resilient lip. This permits only parts of the sealing profile to be configured in a resilient manner and different tolerances to be taken up with different degrees of resilience.

The length of the linear segment is less than 10%, preferably less than 5%, of the length of the concentric segment. Therefore, only a small end piece, relative to the rotational movement, is replaced by a linear end segment.

Moreover, a vehicle is provided, said vehicle comprising a vehicle shell and a cabin according to the invention which is arranged in the vehicle shell.

The vehicle is preferably a motor-operated vehicle, particularly preferably a rail vehicle. In particular in rail vehicles, corresponding cabin doors may be provided, for example for the washroom. The vehicle also encompasses other transport means, such as for example buses, ships and aircraft. Cabins, for example washrooms, may also be closed here by means of the door according to the invention.

The cabin door according to the invention may be operated both manually and automatically.

BRIEF DESCRIPTION OF THE SEVERAL VIEWS OF THE DRAWING

The above-described properties, features and advantages of this invention and the manner in which they are achieved will become clearer and more comprehensible in connection with the following description of the exemplary embodiments which are described in more detail in combination with the drawings, in which.

DESCRIPTION OF THE INVENTION

The invention relates to a cabin door for a vehicle. Hereinafter, the cabin door is shown and explained by way of example as arranged in a rail vehicle. However, it may also be arranged in other vehicles such as buses, ships and aircraft.

By way of example, the cabin according to the invention may accommodate a washroom. However, it may also be a passenger cabin with seats or couchettes.

Figure 1:
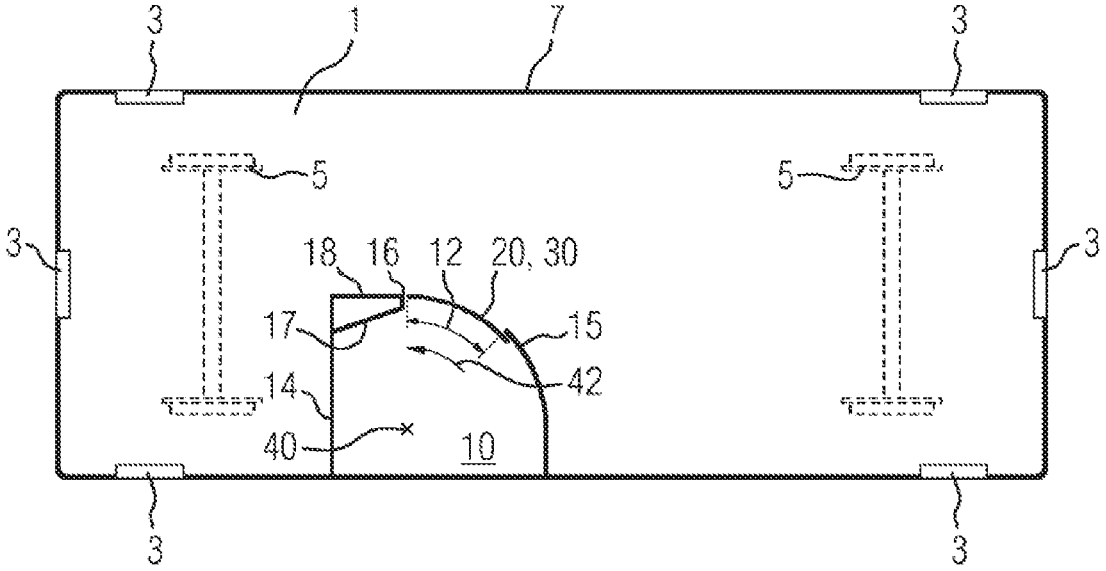
FIG 1 Prior art
FIG. 1 shows a vehicle having a cabin door of the prior art.
Figure 2:
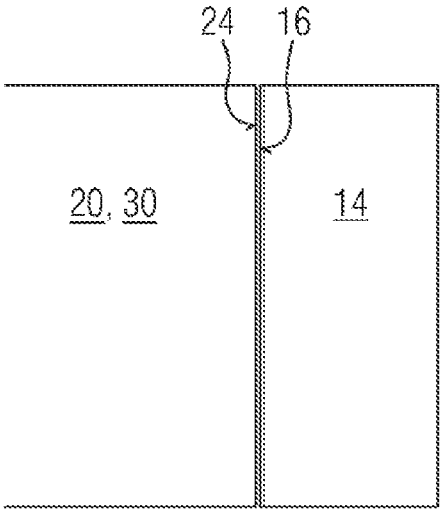
FIG 2 Prior art
FIG. 2 shows a correctly closed cabin door of the prior art.
Figure 3:
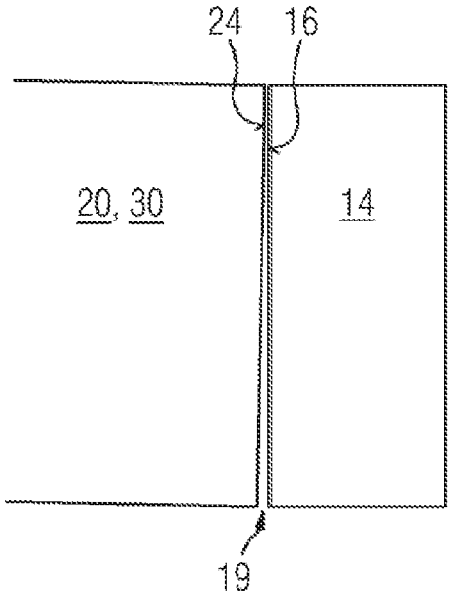
FIG 3 Prior art
FIG. 3 shows an incorrectly closed cabin door of the prior art.
Figure 4:
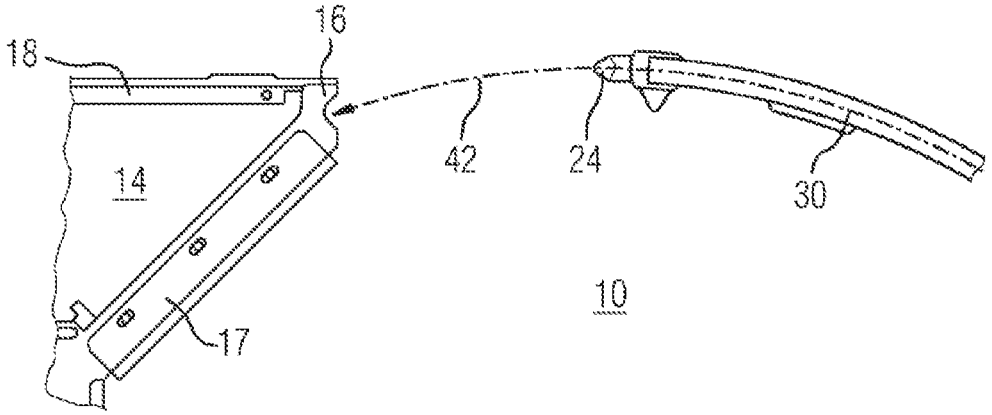
FIG 4 Prior art
FIG. 4 shows a detailed view of the cabin door of the prior art in the open state.
Figure 5:
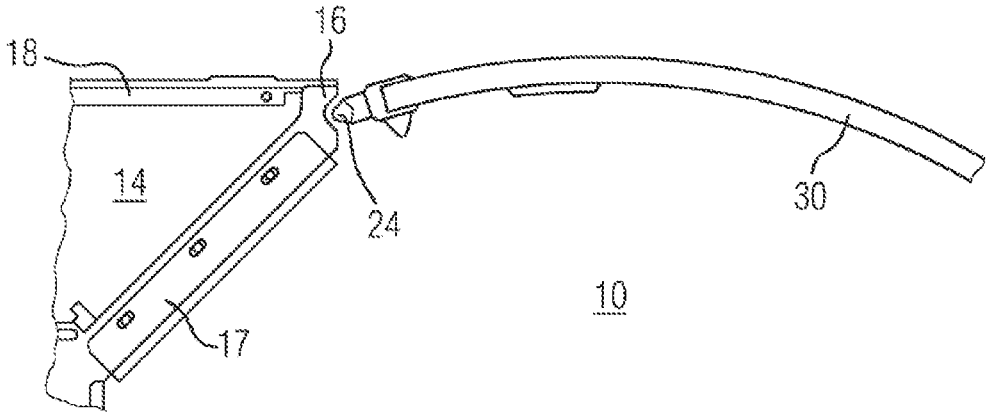
FIG 5 Prior art
FIG. 5 shows a detailed view of the cabin door of the prior art in the closed state.

A rail vehicle 1 having a cabin door 20 of the prior art is shown in FIG. 1. In FIGS. 2 and 3 two examples of a closed state of the cabin door 20 of the prior art are shown. FIGS. 4 and 5 show a detailed view of the cabin door 20 in the open state (FIG. 4) and closed state (FIG. 5).

The rail vehicle 1 comprises by way of example at least two wheel sets 5 which are arranged on the lower face of the rail vehicle. The rail vehicle 1 additionally comprises a plurality of doors 3 for boarding and disembarking from the vehicle 1, wherein the doors are arranged in the outer shell 7 of the vehicle 1. A cabin 10 is arranged in the interior of the vehicle 1. The cabin 10 comprises a cabin wall 14, an opening 12 in the cabin wall and a door 20 for opening and closing the opening 12. The cabin 10 may thus be entered or left through the door 20. The door 20 comprises a door leaf 30 which is configured concentrically. For the opening and closing procedure, the door rotates on a portion of a circular path about a rotational point 40. In the closing direction 42 of the door 20, the cabin wall 14 has a door stop 16. The door stop 16 is defined by an external region 18 and an internal region 17 of the cabin wall 14. In the exemplary embodiment shown, the door stop 16, the outer region 18 and the inner region 17 form a triangular structure. Moreover, the cabin wall 14 has in the region of the door leaf 30 a concentric portion 15 corresponding to the shape of the door leaf 30. In the open state, the concentric portion 15 and the door leaf 30 are located parallel to one another.

FIG. 2 shows a closing edge 24 of the cabin door 20 with the door leaf 30 which bears against the door stop 16 in a plane parallel manner. No gap is formed and the door 20 is correctly closed. In the cabin 10 shown with a door 20 of the prior art, however, in order to ensure a smooth running of the door 20, complex adjustments are required for the concentric door guidance. In the installed state, these complex adjustments may, for example, result from tolerances or the bracing of the cabin 10. By these necessary adjustments, the door leaf 30 is forced out of its true vertical alignment relative to the cabin floor which may lead to undesired gaps 19 at the door stop 16, as shown in FIG. 3. The door 20 is closed incorrectly. Through this gap 19, therefore, it is possible to see into the cabin 10 which is actually closed, which is undesirable. This is undesirable, in particular, in cabins 10 which accommodate a washroom.

To prevent the gap 19 produced by the adjustments, the door stop 16 may be formed by a type of pocket, the front of the door leaf 30 running therein, following the circumference of the circular path, in the closed state. This is shown in FIGS. 4 and 5. As a result, small misalignments of the door leaf 30 relative to the visible gap 19 may be taken up. The pocket function, however, due to the action of shear forces contains an increased risk of trapping the fingers and hands, specifically for children, and in the currently known designs is only able to compensate for small tolerances relative to the vertical gap 19. When closing the door 20, the purely rotational movement results in a frontal approach between the closing edge 24 of the door leaf 20 and the door stop 16.

Figure 6:
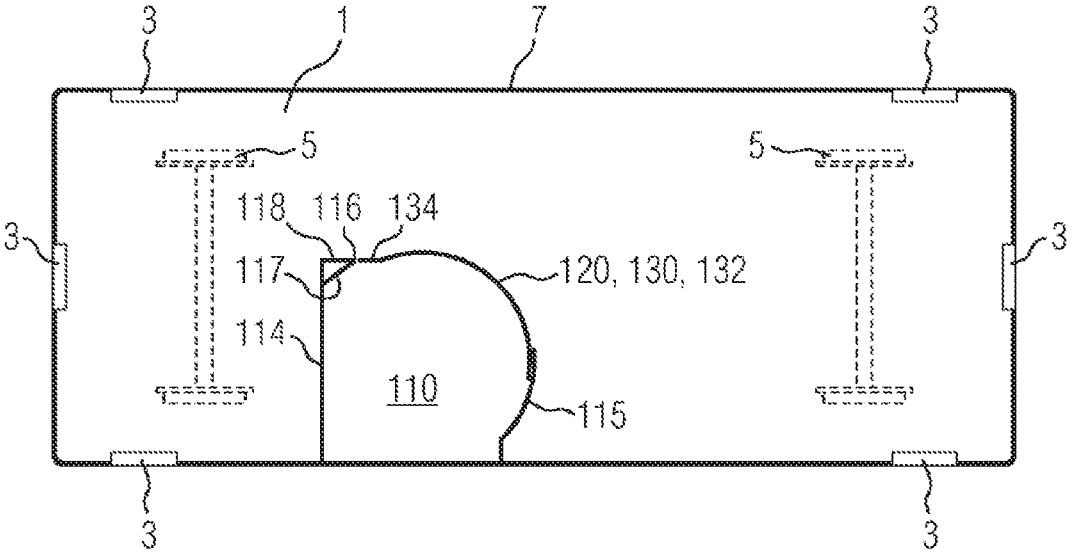
FIG. 6 shows a vehicle having a cabin door according to the invention.
Figure 7:
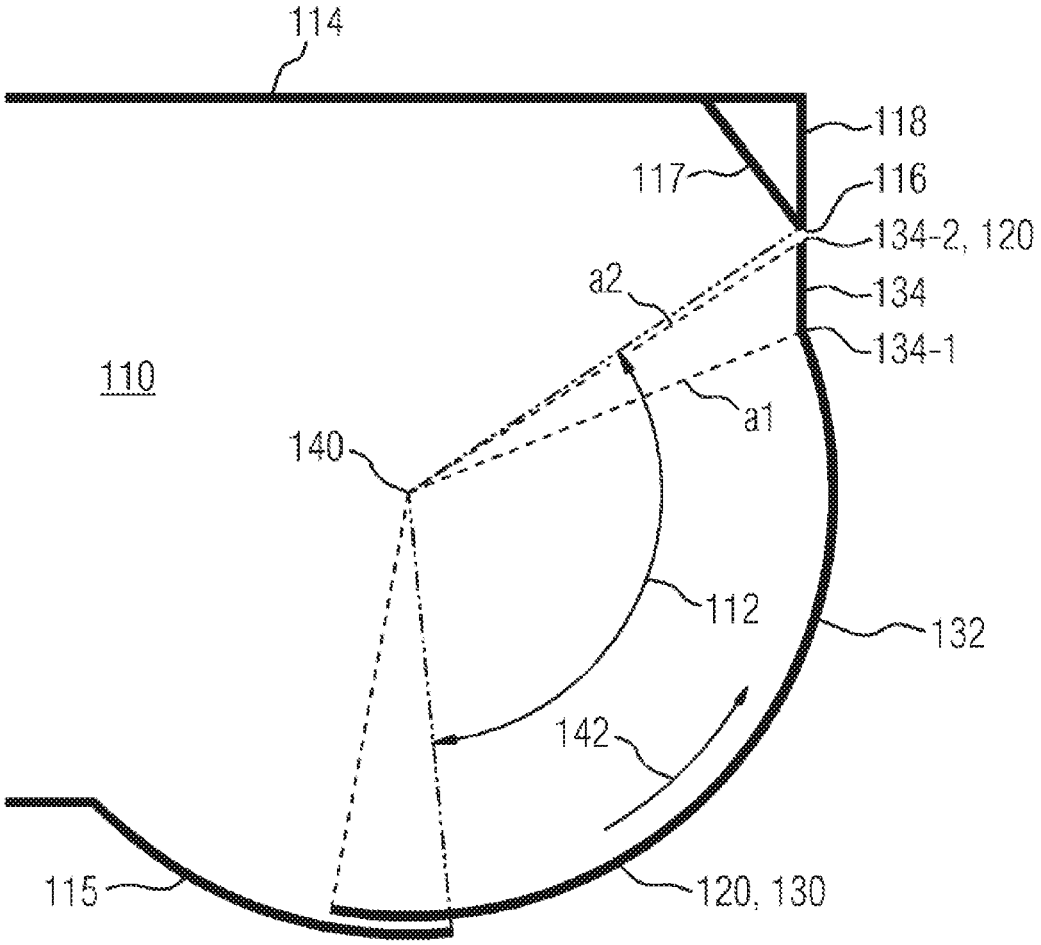
FIG. 7 shows a cabin door according to the invention for a vehicle and FIG. 8 shows a detailed view of a cabin door according to the invention for a vehicle in the open state.
Figure 8:
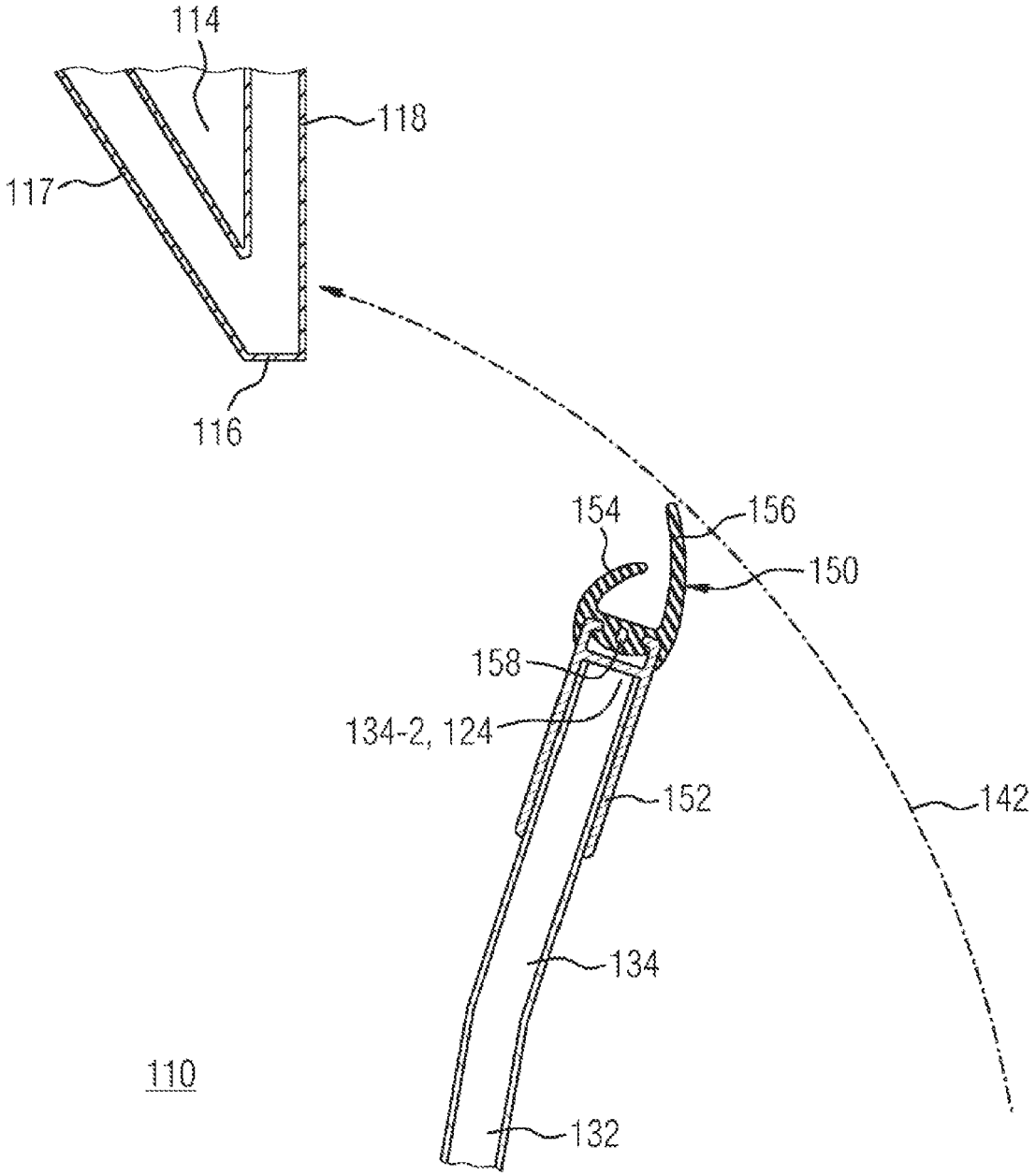
Figure 9:
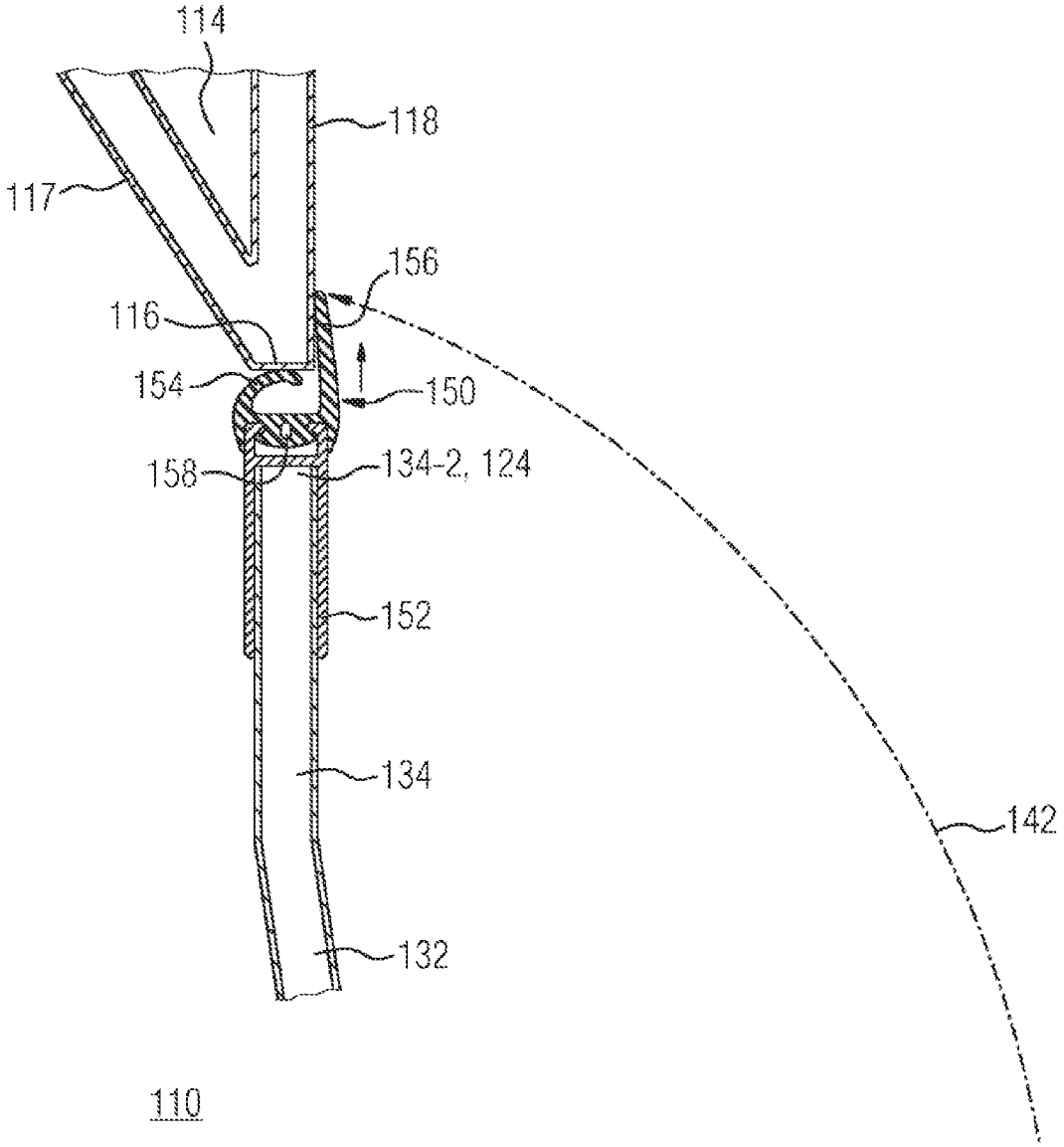
FIG. 9 shows a detailed view of a cabin door according to the invention for a vehicle in the closed state.

FIG. 6 shows a cabin door 120 according to the invention in a vehicle 1. FIG. 7 shows the cabin 110 with the cabin door 120 in an enlarged view. FIGS. 8 and 9 show the door 120 according to the invention in detailed views, once during the closing process (FIG. 8) and once after closing the door 120 (FIG. 9).

The cabin 110 comprises in turn a cabin wall 114 with a concentric wall segment 115 which is arranged parallel to a concentric segment 132 of the door leaf 130 of the door 120. At least in the open state of the door 120 the concentric wall segment 115 and the concentric door leaf segment 132 overlap. The cabin wall 114 has in turn a door stop 116 which, as shown in FIG. 1, is defined by an inner region 117 and an outer region 118 of the cabin wall 114. The door stop 116, the inner region 117 and the outer region 118 form a triangular structure.

The door 120 according to the invention rotates about a rotational point 140 and in the closing direction 142 has a free end 134-2 which forms the closing edge 124 of the door 120. In the closing direction 142 of the door 120 a linear segment 134 adjoins the concentric segment 132 of the door leaf 130, said linear segment being form-lockingly connected by a fixed end 134-1 to the concentric segment 132. The linear segment 134 preferably seamlessly adjoins the narrow edge of the concentric element 132. Preferably the concentric and linear segments 132, 134 have the same thickness and the same height.

In the closed state of the door 120, the closing edge 124 of the door 120 bears form-lockingly against the door stop 116. The door stop 116, as shown in FIG. 6, is preferably configured as a straight edge which connects the inner region 117 to the outer region 118 of the cabin wall 114. The linear segment 134 is configured so as to be bent away outwardly from the circular path. In other words, the distance a1 of the fixed end 134-1 of the linear segment 134 from the rotational point 140 is less than the distance a2 of the free end 134-2 from the rotational point 140.

The concentric segment 132 and the linear segment 134 may be produced from the same material or from different materials. Thus, for example, the linear segment may be configured to be resilient at least on its closing edge 124 in order to reduce the trapping of hands between the closing edge 124 and the door stop 116 and to absorb a contact pressure for improved closing of the door 120.

According to the invention, accordingly, the closing edge of a door leaf which is simply bent is complemented by a linear part which is angled back outwardly. As a result, this leads to a combined rotational and translatory relative movement between the closing edge of the door leaf and the door stop. This is simpler to control.

FIGS. 8 and 9 show detailed views of the procedure of closing the door 120. In FIG. 8 the door is not yet closed and in FIG. 9 the door is in the closed state. The door initially closes in a rotational manner (to the right) and then in a translatory manner (to the left). Preferably, the linear door segment 134 has a sealing profile 150 on its free end 134-2. By the choice of a suitable sealing profile 150, for example a rubber profile, a generous covering of the gaps which result from misalignments of the door leaf 130 may be achieved. The sealing profile 152 preferably extends over the entire height of the door 120 which is visible from outside. Thus the sealing profile is configured such that in the closed state of the door 120 in the outer region 118 of the opening 112 of the door 120 the sealing profile completely covers the transition between the closing edge 124 and the door stop 116 horizontally and vertically. In this case the sealing profile 150 overlaps the outer region 118 of the cabin wall 114 such that possible gaps due to alignments are covered from outside. By means of the sealing profile 150, therefore, a generous covering of the gaps resulting from misalignments of the door leaf 130 may be achieved. At the same time, the trapping of hands may be eliminated. A large distance between the rigid components of the door leaf 130 and the door stop 116 may be produced, since the resilient flexible sealing profile 150 creates a gap closure. The sealing profile 150 firstly bears against the outer region 118 of the cabin wall 114, and secondly it is preferably configured between the closing edge 124 and the door stop 114. This permits an absorption of the linear kinetic energy during the last phase of the closing procedure of the door 120.

By the use of a sealing profile 150 a simpler alignment of the door may be achieved during the first installation and during maintenance. This leads to time-saving during installation and maintenance, since the adjustment only has to be directed toward the running properties during the opening and closing procedure.

In the exemplary embodiment shown, the sealing profile 150 is positioned with two linear partial regions 152 onto the free end 134-2 of the linear segment 134. This permits a simple mounting and dismantling of the sealing profile 150. However, the sealing profile may also be securely bonded or fastened otherwise. Between the door stop 116 and the free end 134-1, the sealing profile 150 has a first resilient element 154 which is configured to absorb a linear force between the door stop 116 and the free end 134-1. Shown by way of example, the first resilient element 154 has a nose-like or hook-like shape. The first resilient element is compressed in the direction of the free end 134-1 when the door 120 is closed. Moreover, the sealing profile 150 comprises a second resilient element 156 which bears from outside against the outer region 118 of the cabin door 120. By way of example, the second resilient element 156 has the shape of a lip. When the door is closed 120 the lip is bent in a linear manner in order to bear against the outer region 118 of the cabin wall 114 around the opening 112.

The sealing profile 150 may be configured in one piece as a resilient element or may even consist of at least two separate first and second resilient elements 154, 156.

Moreover, the resilient element may also be arranged rotatably about a rotational point 158 at the free end 134-1 of the linear segment 134. This may permit an even better form-locking connection between the sealing profile 150 and the outer region 118 of the cabin wall 114. Preferably, the rotatable sealing profile 150 may then be arranged so as to be pretensioned in the direction of the outer region 118, so that the rotation is only able to be carried out counter to a spring force.

Whilst the invention in detail has been illustrated and described more clearly by preferred exemplary embodiments, the invention is not limited by the disclosed examples and other variants may be derived therefrom by the person skilled in the art without departing from the protected scope of the invention.

The invention claimed is:

1. A cabin for a vehicle, the cabin comprising:

a cabin wall having an opening and a door stop;

a door being movable about a rotational point for opening and closing said opening, said door including a door leaf being movable toward said door stop in a closing direction of said door;

said door leaf having a concentric segment and a linear segment with a fixed end and a free end, said fixed end being disposed at a distance from said rotational point being less than a distance between said free end and said rotational point;

said fixed end of said linear segment adjoining said concentric segment in said closing direction of said door; and said free end of said linear segment forming a closing edge in said closing direction of said door, said closing edge lying against said door stop in a closed state of said door.

2. The cabin according to claim 1, which further comprises a resilient sealing profile disposed at said free end of said linear segment of said door leaf.

3. The cabin according to claim 2, wherein said sealing profile, in said closed state of said door, bears against said cabin wall from outside said cabin wall in a vicinity of said opening.

4. The cabin according to claim 2, wherein said sealing profile, in said closed state of said door, partially or entirely covers said closing edge of said door and said door stop from outside.

5. The cabin according to claim 2, wherein said sealing profile bears against said door stop for said door.

6. The cabin according to claim 2, wherein said sealing profile includes a first resilient element bearing between said free end of said linear segment and said door stop, in said closed state of said door.

7. The cabin according to claim 6, wherein said first resilient element is a resilient nose.

8. The cabin according to claim 6, wherein said sealing profile includes a second resilient element bearing against said cabin wall from outside, in said closed state of said door.

9. The cabin according to claim 8, wherein said second resilient element is a resilient lip.

10. The cabin according to claim 1, wherein said linear segment has a length being less than 10% of a length of said concentric segment.

11. The cabin according to claim 1, wherein said linear segment has a length being less than 5% of a length of said concentric segment.

12. A vehicle, comprising:

a vehicle shell; and a cabin according to claim 1 disposed in said vehicle shell.

13. The cabin according to claim 1, wherein said fixed end and said concentric segment enclose an angle other than 180 degrees therebetween.

* * * * *